United States Patent [19]

Nakase

[11] Patent Number: 4,583,953

[45] Date of Patent: Apr. 22, 1986

[54] OUTBOARD MOTOR

[75] Inventor: Ryoichi Nakase, Hamamatsu, Japan

[73] Assignees: Yamaha Hatsudoki Kabushiki Kaisha; Sanshin Kogyo Kabushiki Kaisha, both of Japan

[21] Appl. No.: 742,130

[22] Filed: Jun. 6, 1985

Related U.S. Application Data

[63] Continuation of Ser. No. 471,314, Mar. 2, 1983, abandoned.

[30] Foreign Application Priority Data

Mar. 11, 1982 [JP] Japan ..... 57-37293

[51] Int. Cl.[4] ..... B63H 1/15

[52] U.S. Cl. ..... 440/52; 440/76; 440/89

[58] Field of Search ..... 440/52, 89, 900, 78, 440/76, 77, 88; 192/81 C

[56] References Cited

U.S. PATENT DOCUMENTS

| | | | |
|---|---|---|---|
| 677,872 | 7/1901 | Locke | 192/81 C |
| 2,585,774 | 2/1952 | Heidner | 440/52 |
| 2,909,031 | 10/1959 | Kiekhaefer | 440/52 |
| 2,916,007 | 12/1959 | Kiekhaefer | 440/52 |
| 2,936,591 | 5/1960 | Leipert | 440/52 |
| 2,950,701 | 8/1960 | Stefani | 440/52 |
| 3,002,489 | 10/1961 | Watkins | 440/52 |
| 3,090,463 | 5/1963 | Yanoa | 440/52 |
| 3,127,866 | 4/1964 | Mohr | 440/52 |
| 3,195,521 | 7/1965 | Larsen | 440/89 |
| 3,198,162 | 8/1965 | Larsen | 440/52 |
| 3,501,929 | 3/1970 | Kashmerick | 440/52 |
| 3,845,923 | 11/1974 | Atkinson | 440/52 |
| 4,323,356 | 4/1982 | Stephenson | 440/86 |

*Primary Examiner*—Sherman D. Basinger
*Attorney, Agent, or Firm*—Ernest A. Beutler

[57] ABSTRACT

Several embodiments of vibration damping devices for preventing the transmission of vibrations from the power head of an outboard motor to the transom of the boat to which it is attached. In each embodiment, a vibration damping pad is interposed between the power head and the drive shaft housing to isolate vibrations. In accordance with another feature of the invention, a flexible coupling is interposed between the engine output shaft and the drive shaft for permitting relative vibration damping between the power head and the drive shaft housing. A number of embodiments are disclosed that show various arrangements through which the vibration damping pad is affixed to a pair of supporting plates. In addition, an arrangement is provided for cooling the vibration damping pad in the area through which exhaust gases are passed from the engine to the drive shaft housing.

13 Claims, 7 Drawing Figures

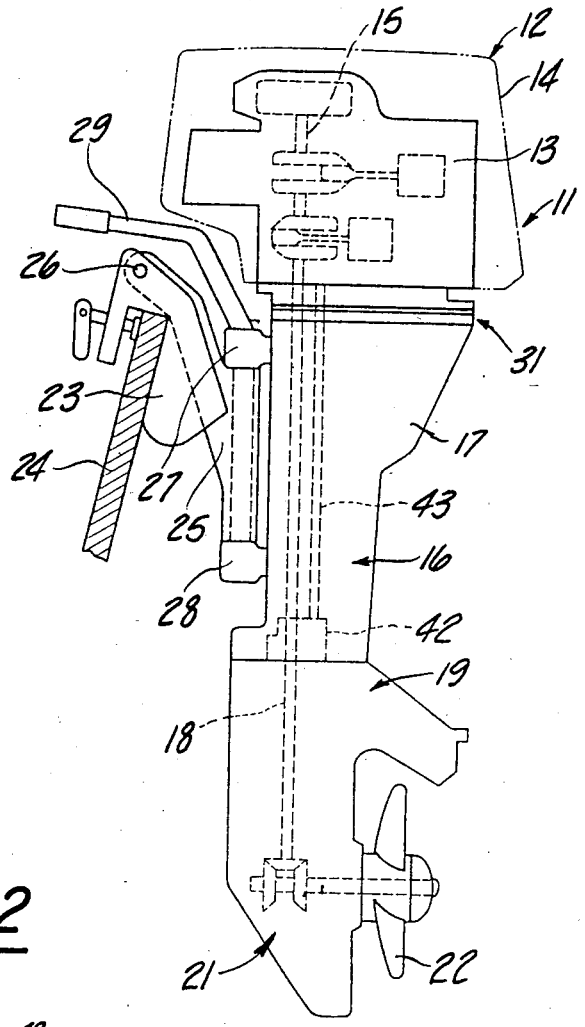
Fig-1
Fig-2
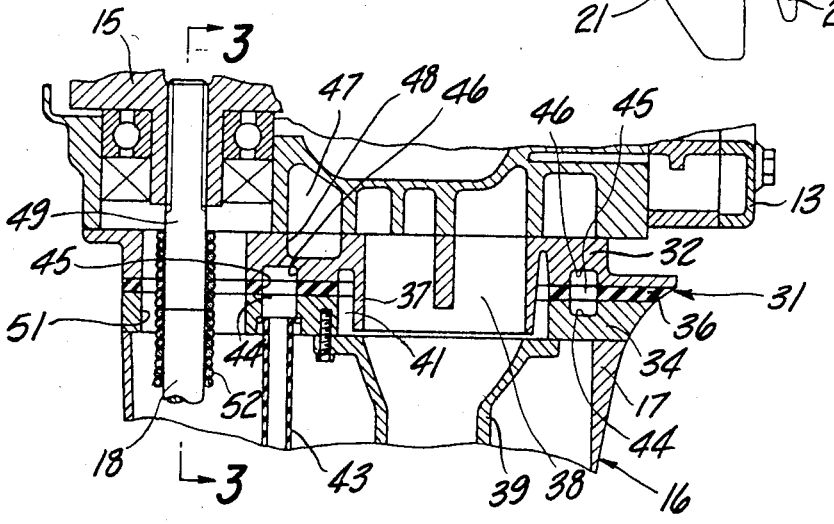

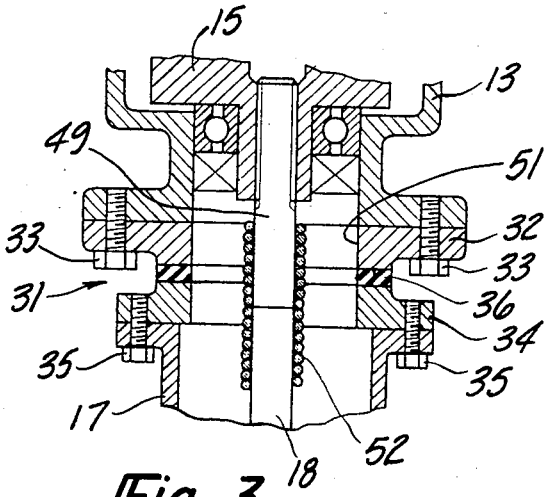
Fig-3
Fig-5
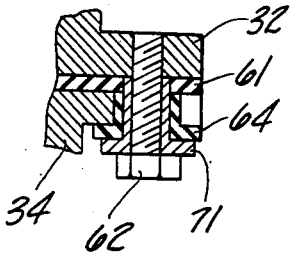
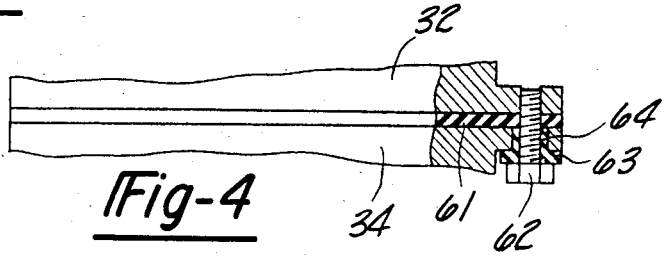
Fig-4
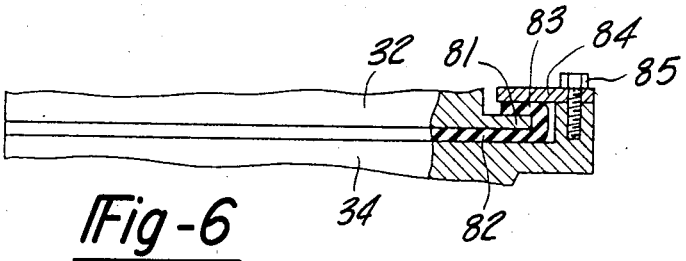
Fig-6
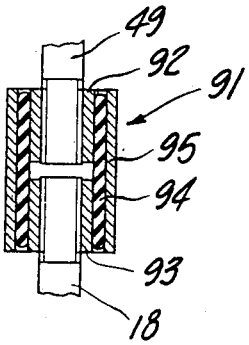
Fig-7

OUTBOARD MOTOR

This application is a continuation of application Ser. No. 471,314, filed Mar. 2, 1983 and now abandoned.

BACKGROUND OF THE INVENTION

This invention relates to an outboard motor and more particularly to an improved vibration and sound damping arrangement for such a motor.

As is well known, an outboard motor normally consists of three discrete units, a power head, a drive shaft housing and a lower unit that are bolted or otherwise secured rigidly together. The motor is mounted to the transom of a boat by means of a clamping bracket, swivel bracket and steering arrangement that normally is connected directly to the drive shaft housing of the motor. Although the internal combustion engine that forms a portion of the power head is normally contained within an outer cowling, the cowling is generally such that it does not effectively silence or dampen engine vibrations and noises. Furthermore, because the power head is directly coupled to the drive shaft housing, which is in turn affixed to the transom of the boat, vibrations are readily transmitted from the engine to the boat. The protective cowling structure normally used for the power head consists of a thin aluminum alloy or similar material. Such materials, however, have a relatively high natural frequency of vibration. Therefore, the protective cowling rather than eliminating vibrations can in fact resonate at a high frequency in sympathy with the engine and produce objectionable noice.

It is, therefore, a principal object of this invention to provide an improved vibration damping arrangement for an outboard motor.

It is a further object of the invention to provide an outboard motor in which vibrations from components of the motor are isolated from the transom of the associated boat.

It is a further object of this invention to provide an improved and simplified vibration dampening arrangement between the power head and transom of a boat so as to reduce vibrations and noise.

SUMMARY OF THE INVENTION

This invention is adapted to be embodied in an outboard motor or the like that comprises a power head including an internal combustion engine, a drive shaft housing depending from the power head and containing a drive shaft driven by the engine and a lower unit depending from the drive shaft housing and supporting a propeller that is adapted to be driven by the drive shaft. In accordance with the invention, vibration damping means are interposed between the power head and the drive shaft housing for minimizing the transmission of vibrations therebetween.

BRIEF DESCRIPTION OF THE DRAWINGS

FIG. 1 is a side elevational view of an outboard motor constructed in accordance with this invention and attached to the transom of a boat, which transom is shown in cross-section.

FIG. 2 is an enlarged, cross-sectional view showing the connection between the power head and drive shaft housing of the motor in accordance with a first embodiment of the invention.

FIG. 3 is a cross-sectional view taken along the line 3—3 of FIG. 2.

FIG. 4 is a cross-sectional view, in part similar to FIG. 3, showing another embodiment of vibration damping connection between the power head and drive shaft housing.

FIG. 5 is a cross-sectional view, in part similar to FIGS. 2 and 4, showing a further embodiment of the invention.

FIG. 6 is a cross-sectional view, in part similar to FIGS. 2, 4 and 5 showing s still further embodiment of the invention.

FIG. 7 is a cross-sectional view, in part similar to FIG. 3, showing another embodiment of a vibration damping arrangement between the output shaft of the engine and the drive shaft.

DETAILED DESCRIPTION OF THE PREFERRED EMBODIMENTS OF THE INVENTION

Referring first to FIG. 1, an outboard motor having a general construction which is common to all embodiments of the invention is identified generally by the reference numeral 11. The engine 11 includes a power head 12 that consists of an internal combustion engine of any known type 13 and a surrounding protective housing, which is shown in phantom and is identified by the reference numeral 14. In the illustrated embodiment, the engine 13 is of the reciprocating type and includes a crankshaft 15. It is to be understood that any of the known types of internal combustion engines can be employed and the shaft 15 may be considered to be the output shaft of any of such engines.

A drive shaft housing 16 is affixed, in a manner to be described, to the power head 12 and depends from it. The drive shaft housing 16 includes an outer housing 17 through which a drive shaft 18 extends. The drive shaft 18 is coupled to the engine output shaft 15 in a manner to be described.

A lower unit 19 is affixed to and depends from the drive shaft housing 16. The drive shaft 18 extends through the lower unit 19 and terminates at a change gear transmission 21 which may be of any known type and which is adapted to drive a propeller 22 in a known manner.

A clamp bracket 23 is adapted to be affixed to a transom 24 of an associated watercraft. A swivel bracket 25 is, in turn, affixed to the clamp bracket 23 for tilting movement about a horizontally disposed axis defined by a pivot pin 26. The drive shaft housing 16 is affixed to the swivel bracket 25 for steering rotation about a generally vertically extending axis by means of a pair of connecting members 27 and 28. A tiller 29 is affixed to one of the connecting members (the member 27 in this embodiment) for steering of the motor 11 about this steering axis.

With conventional engines, the vibrations generated by the engine 13 are transmitted through the drive shaft housing 16 to the boat transom 24. In addition, the relatively thin cowling 14 of the power head 12 is normally such that it will vibrate at a relatively high frequency in resonance with the engine so as to amplify the vibrations that are transmitted to the transom 24. In accordance with this invention, a vibration isolating assembly, indicated generally by the reference numeral 31, is interposed between the power head 12 and drive shaft housing 16 so as to minimize the transmission of such vibrations.

A first embodiment of the invention is shown in specific detail in FIGS. 2 and 3 and reference will now be had to those figures to describe this embodiment.

The vibration isolating assembly 31 includes an upper metallic plate 32 that is affixed, as by bolts 33 (FIG. 3) or the like to the underside of the engine 13. A lower metallic plate 34 is spaced from the plate 32 and is affixed to the upper side of the drive shaft housing by means of bolts 35 (FIG. 3) or the like. The plates 32 and 33 are connected to each other through the intermediary of a vibration isolating pad 36. The pad 36 may be formed from rubber or any suitable elastomeric material having vibration damping characteristics such as a synthetic resin or the like. The plates 32 and 34 are vulcanized, bonded or adhesively secured to the vibration isolating pad 36.

As is well known, it is the conventional practice to discharge the exhaust gases from the engine 13 downwardly through the drive shaft housing 16 and lower unit 19 so that the exhaust gases will be discharged normally beneath the water level when the boat is travelling at a medium or high speed through the water. For this purpose, the upper plate 39 is formed with a depending flange 37 that defines an exhaust gas passage 38 that is adapted to cooperate with the exhaust ports of the engine 13 so as to collect the exhaust gases. The flange 37 cooperates with the inlet end of an exhust pipe 39 that is afixed to the lower plate 34 and which depends into the drive shaft housing 16 for delivering the exhaust gases to a silencing arrangement including an expansion chamber contained within the drive shaft housing 16. Inasmuch as the method of exhaust gas silencing and discharge forms no part of this invention except for the method of transfer of exhaust gases through the vibration isolating assembly 31, this portion of the exhaust system has not been illustrated nor will it be described.

Obviously, the exhaust gases will be heated and an arrangement should be provided for isolating this heat from the vibration isolating pad 36. For this purpose, the plate flange 37 is spaced inwardly from an opening through the pad 36 and an opening in the lower plate 34 so as to provide an insulating air gap, indicated at 41. This air gap provides heat insulation between the flange 36 and the adjacent portion of the vibration isolating pad 36.

As is well known with outboard motors, the engine 13 is water cooled. Water is delivered to the engine 13 from a water pump 42 (FIG. 1) that is positioned at the lower end of the drive shaft housing 16 and which is driven by the drive shaft 18 in a known manner. Water from the water pump 42 is transferred upwardly through the drive shaft housing 16 via a water delivery tube 43. Referring now again to FIG. 2, the upper end of the water delivery tube 43 mates with a water delivery passage 44 formed in the lower plate 34 at one side of the annular exhaust cooling gap 41. A corresponding passage 45 is formed in the vibration isolating pad 36 which, in turn, mates with a passage 46 formed in the upper plate 32. The passage 46 delivers water to a water cooling jacket inlet port 47 of the engine 13 through a delivery port 48.

The cavities 41, 45 and 46 in the lower plate 34, vibration isolating pad 36 and upper plate 32 extend annularly around the exhaust gas cooling air gap 41 so as to provide water cooling for the pad 36 in the area where it surrounds the exhaust gas cooling passage 41. Thus, further cooling of the vibration isolating pad 36 is provided by the cooling water which is delivered to the engine 13.

An arrangement is also incorporated for minimizing the transmission of vibrations from the engine output shaft 15 to the drive shaft 18. In accordance with this feature of the invention, a stub shaft 49 has a splined connection to the output shaft 15 and depends downwardly through an opening 51 formed in the vibration isolating assembly 31. The upper end of the drive shaft 18 and the lower end of the stub shaft 49 are encircled by coiled spring 52 that snugly engages the outer periphery of the shafts 49 and 18. The spring 52 is of such a hand that it acts as a spring clutch so as to wind more tightly upon rotation of the output shaft 15 in its normal direction to transmit the drive between the stub shaft 49 and the drive shaft 18.

The spring 52 is resilient in directions perpendicular to its longitudinal axis so as to accommodate and absorb vibrations. This property of the spring 52 will freely permit the power head 12 to vibrate independently of the drive shaft housing 16 under the influence of the vibration isolation pad 36. In this way, objectionable noises are effectively isolated from the boat transom 24.

In the embodiments of FIGS. 1 through 3, the vibration isolating assembly was comprised of upper and lower plates that were bonded or adhesively secured to the vibration isolating pad. Rather than using a chemical or adhesive bonding, the three elements may be mechanically connected together. FIGS. 4, 5 and 6 show three different embodiments of mechanical connections. In these embodiments, the upper and lower plates have been again identified by the reference numerals 32 and 34 and except as hereinafter described, their construction may be considered to be the same as the previously described embodiment. The same is generally true with respect to the vibration isolating pad in connection with the embodiments of FIGS. 4 through 6. However, since the mechanical method by which the pad is secured to the plates is different, the pad has been given a different number in each of these embodiments. It is to be understood that the method of cooling the pad and isolating it from the exhaust gases in connection with these embodiments may be the same as the previously described embodiment. For this reason, this portion of the pads and the associated components of the upper and lower plates has not been illustrated in detail and will not be described again.

Referring first to the embodiment of FIG. 4, a vibration isolating pad has been identified generally by the reference numeral 61. In accordance with this embodiment, a plurality of bolts 62 extend through elastomeric bushings 63 received in openings 64 formed in the lower plate 34 and are tapped into threaded openings in the upper plate 32. The pad 61 is also formed with openings to clear the bolt 62. In this way, the upper and lower plates 32, 34 and pad 61 are mechanically secured to each other. However, the pad 61 is free to permit vibration of the plates 32 and 34 relative to each other. Since the bolt 62 is only directly mechanically coupled to the plate 32 and because of the elastomeric bushing, there is no rigid mechanical connection between the bolt 62 and the lower plate 34 that would resist the relative vibration and, accordingly, damping.

FIG. 5 shows an embodiment similar to FIG. 4. However, in this embodiment, a metallic bushing 71 encircles the bolts 62 and bears against the lower face of the upper plate 32 so as to limit the compression of the elastomeric bushing 64 and also the compression of the vibration isolating pad 61. In all other details, the embodiment of FIG. 5 is the same as the embodiment of FIG. 4.

In connection with the embodiments of FIGS. 4 and 5, rather than using separate bolts 62 so as to secure the plates 32 and 34 to each other, the same bolts may be used as are to secure the upper plate 32 to the engine 13. Alternatively, the bolting arrangement may be reversed so that the bolt is threaded into the lower plate 34 or, alternatively, are the bolts that are used to attach the lower plate 34 to the drive shaft housing 16.

Referring now to the embodiment of FIG. 6, the upper plate 32 is formed with a peripheral flange 81. A vibration isolating pad 82 of suitable material as aforedescribed has a U-shaped peripheral edge 83 that extends around and embraces the upper plate flange 81. A clamping plate 84 is affixed by a plurality of screws 85 to the lower plate 34 and has a cantilevered end that engages the upper portion of the pad U-shaped section 83 so as to maintain the parts in engagement. Thus, the parts are affixed to each other but are free to absorb vibrations. As was described in conjunction with the embodiments of FIGS. 4 and 5, the arrangement may be reversed wherein the lower plate 34 has the peripheral flange and the clamping plate 84 is affixed to the upper plate.

FIG. 7 illustrates an elastic joint 91 that may be used to couple the stub shaft 49 to the drive shaft 18 in lieu of the spring clutch 52 of the embodiments of FIGS. 1 through 3. In accordance with this embodiment, the coupling 91 includes an upper metallic sleeve 92 that is splined to the lower end of the stub shaft 49 and a lower metallic sleeve 93 that is splined to the upper end of the drive shaft 18. An elastomeric sleeve formed from rubber or the like and indicated generally by the reference numeral 94 is bonded or otherwise secured to the outer periphery of the sleeves 92 and 93 and spans the gap between them. The outer periphery of the elastomeric sleeve 94 is bonded to the inner periphery of an elongated, outer metallic sleeve 85 that spans the sleeves 92 and 93.

The coupling 91 obviously transfers rotation between the stub shaft 49 and the drive shaft 18 and yet will permit vibration absorption due to torsional and transverse deflections. Thus, the embodiment operates to achieve substantially the same effect as the embodiment of FIGS. 1 through 3, however, without the clutching action.

From the foregoing description, it should be readily apparent that a variety of embodiments have been illustrated and described that permit effective vibration isolation from the power head to the transom of the boat. Although a number of embodiments have been illustrated and described, various other changes and modifications may be made without departing from the spirit and scope of the invention, as defined by the appended claims.

I claim:

1. In an outboard motor or the like comprising a power head including an internal combustion engine and a surrounding protective cowling, a drive shaft housing depending from said power head and containing a drive shaft driven by said engine, and a lower unit depending from said drive shaft housing and supporting a propeller adapted to be driven by said drive shaft, the improvement comprising vibration damping means interposed between said power head including both said engine and said protective cowling and said drive shaft housing for minimizing the transmission of vibrations therebetween comprising a vibration damping pad interposed between the interface of said power head and said drive shaft housing and fixed relative to each of said power head and said drive shaft housing and thus forming the sole connection therebetween, said vibration damping pad being formed with openings therein for passage of water between the cooling jacket of said engine and said drive shaft housing and for the passage of exhaust gases from said engine to said drive shaft housing.

2. In an outboard motor as set forth in claim 1 wherein the vibration damping means further comprises a vibration damping coupling between the output shaft of the engine and the drive shaft in vertical alignment with said vibration damping pad.

3. In an outboard motor as set forth in claim 2 wherein the vibration damping coupling comprises a spring clutch.

4. In an outboard motor as set forth in claim 2 wherein the vibration damping coupling comprises an elastic joint.

5. In an outboard motor as set forth in claim 1 wherein an exhaust system transfers exhaust gases from the engine downwardly through one of the vibration damping pad openings into the drive shaft housing.

6. In an outboard motor as set forth in claim 5 wherein the vibration damping means further includes an upper plate affixed to the upper side of the vibration damping pad and a lower plate affixed to the lower side of the vibration damping pad, one of said plates having a heat protecting shield extending through the opening in the pad through which the exhaust gases pass and spaced therefrom to provide a cooling air gap therebetween.

7. In an outboard motor as set forth in claim 6 wherein the heat shield extends from the plate from which it is formed to a point contiguous to the termination of the other plate.

8. In an outboard motor as set forth in claim 7 further including a water cooling jacket encircling the area of the pad that defines the exhaust gas opening.

9. In an outboard motor as set forth in claim 5 further including a water cooling jacket encircling the area of the pad that defines the exhaust gas opening.

10. In an outboard motor as set forth in claim 9 wherein there is a water pump disposed in the drive shaft housing and driven by the drive shaft for delivering coolant to the engine, the coolant jacket surrounding the vibration damping pad exhaust gas opening being supplied with coolant by said coolant pump.

11. In an outboard motor as set forth in claim 1 wherein the vibration damping means further comprises an upper plate affixed relative to the upper side of the vibration damping pad and to the power head and a lower plate affixed to the lower side of the vibration damping pad and to the drive shaft housing.

12. In an outboard motor as set forth in claim 11 wherein the plates are adhesively bonded to the vibration damping pad.

13. In an outboard motor or the like comprising a power head including an internal combustion engine and a surrounding protective cowling, a drive shaft housing depending from said power head and containing a drive shaft driven by said engine, and a lower unit depending from said drive shaft housing and supporting a propeller adapted to be driven by said drive shaft, the improvement comprising vibration damping means interposed between said power head including both said engine and said protective cowling and said drive shaft housing for minimizing the transmission of vibrations therebetween comprising a resilient vibration damping pad interposed between the interface of said power head and said drive shaft housing, means including an upper plate affixed relative to the upper face of said damping pad for affixing said upper face of said damping pad relative to said power head and including a lower plate affixed relative to the lower face of said damping pad for affixing said lower face of said damping pad to said drive shaft housing so that said power head including said engine and said protective cowling may move as a unit relative to said drive shaft housing to absorb vibrations upon resilient deflection of said damping pad, one of said plates being formed with an outwardly extending flange and said damping pad having a U-shaped peripheral edge encircling said flange and being held in engagement therewith by retaining means for mechanically interlocking said damping pad wth said one plate, said vibration damping pad being formed with openings therein for passage of water between the cooling jacket of said engine and said drive shaft housing and for the passage of exhaust gases from said engine to said drive shaft housing.

* * * * *